US009700762B1

(12) United States Patent
Parnell

(10) Patent No.: US 9,700,762 B1
(45) **Date of Patent: *Jul. 11, 2017**

(54) GOLF BALL COVERS COMPOSED OF PPDI-BASED THERMOPLASTIC POLYURETHANE

(71) Applicant: Callaway Golf Company, Carlsbad, CA (US)

(72) Inventor: Shane R. Parnell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 103 days.

This patent is subject to a terminal disclaimer.

(21) Appl. No.: 14/621,832

(22) Filed: Feb. 13, 2015

Related U.S. Application Data

(63) Continuation of application No. 13/677,673, filed on Nov. 15, 2012, now Pat. No. 8,956,250.

(60) Provisional application No. 61/562,054, filed on Nov. 21, 2011.

(51) Int. Cl.

| | |
|---|---|
| ***A63B 37/04*** | (2006.01) |
| ***A63B 37/06*** | (2006.01) |
| ***A63B 37/12*** | (2006.01) |
| ***A63B 37/00*** | (2006.01) |

(52) U.S. Cl.
CPC ..... *A63B 37/0077* (2013.01); *A63B 37/0033* (2013.01); *A63B 37/0043* (2013.01); *A63B 37/0045* (2013.01); *A63B 37/0046* (2013.01); *A63B 37/0064* (2013.01); *A63B 37/0065* (2013.01); *A63B 37/0094* (2013.01)

(58) Field of Classification Search
USPC ..... 473/351–378
See application file for complete search history.

(56) References Cited

U.S. PATENT DOCUMENTS

| | | | | |
|---|---|---|---|---|
| 5,120,791 | A * | 6/1992 | Sullivan | A63B 37/0003 473/356 |
| 5,334,673 | A * | 8/1994 | Wu | A63B 37/0003 260/998.14 |
| 5,692,974 | A * | 12/1997 | Wu | C08G 18/0814 156/145 |
| 5,908,358 | A * | 6/1999 | Wu | C08G 18/003 473/361 |
| 6,117,024 | A * | 9/2000 | Dewanjee | A63B 37/0003 473/351 |
| 6,159,110 | A * | 12/2000 | Sullivan | A63B 37/0003 473/374 |
| 6,190,268 | B1 * | 2/2001 | Dewanjee | A63B 37/0003 473/370 |
| 6,210,294 | B1 * | 4/2001 | Wu | A63B 37/0003 473/372 |
| 6,361,454 | B1 * | 3/2002 | Yoshida | A63B 37/0003 473/374 |
| 6,369,125 | B1 * | 4/2002 | Nesbitt | A63B 37/0053 473/354 |

(Continued)

*Primary Examiner* — Alvin Hunter
(74) *Attorney, Agent, or Firm* — Michael A. Catania; Sonia Lari; Rebecca Hanovice

(57) ABSTRACT

A golf ball comprising a cover composed of a PPDI-based thermoplastic polyurethane material. The phase morphology of the PPDI-based thermoplastic polyurethane material coupled with high levels of hard segment domain cohesion imparts excellent low temperature flexibility, rubber like elasticity, and mechanical properties to the final elastomer.

5 Claims, 3 Drawing Sheets

(56) References Cited

U.S. PATENT DOCUMENTS 6,392,002 B1 * 5/2002 Wu ..... A63B 37/0003 473/354
6,461,251 B1 * 10/2002 Yamagishi ..... A63B 37/0003 473/376
6,468,168 B1 * 10/2002 Nesbitt ..... A63B 37/0003 473/357
6,468,169 B1 * 10/2002 Hayashi ..... A63B 37/0003 473/354
6,686,436 B2 * 2/2004 Iwami ..... A63B 37/0003 473/378
6,689,860 B2 * 2/2004 Iwami ..... A63B 37/0003 473/373
6,835,793 B2 * 12/2004 Yokota ..... A63B 37/0003 473/374
6,846,898 B2 * 1/2005 Yokota ..... A63B 37/0003 473/378
6,849,006 B2 * 2/2005 Cavallaro ..... A63B 37/0003 473/376
6,855,076 B2 * 2/2005 Matroni ..... A63B 37/0003 473/378
6,949,595 B2 * 9/2005 Morgan ..... A63B 37/0003 473/374
6,987,159 B2 * 1/2006 Iwami ..... A63B 37/0003 473/378
7,153,926 B2 * 12/2006 Isogawa ..... A63B 37/0003 473/357
7,566,280 B2 * 7/2009 Shindo ..... A63B 37/0003 473/351
7,625,302 B2 * 12/2009 Watanabe ..... A63B 37/0004 473/376
7,628,714 B2 * 12/2009 Tarao ..... A63B 37/0023 473/378
8,211,976 B2 * 7/2012 Kim ..... A63B 37/0003 473/371
8,475,298 B2 * 7/2013 Ogg ..... A63B 37/0003 473/376
8,876,635 B1 * 11/2014 Ogg ..... A63B 37/0031 473/376
8,956,250 B1 * 2/2015 Parnell ..... A63B 37/0031 473/376
8,974,318 B1 * 3/2015 Ogg ..... A63B 37/0076 473/376
9,005,052 B1 * 4/2015 Parnell ..... A63B 37/0051 473/376
9,050,502 B1 * 6/2015 Bartels ..... A63B 37/0076
9,278,260 B1 * 3/2016 Bartels
9,320,943 B1 * 4/2016 Bartels ..... A63B 37/0087

* cited by examiner

GOLF BALL COVERS COMPOSED OF PPDI-BASED THERMOPLASTIC POLYURETHANE

CROSS REFERENCES TO RELATED APPLICATIONS

The present application is a continuation application of U.S. patent application Ser. No. 13/677,673, filed on Nov. 15, 2012, which claims priority to U.S. Provisional Patent Application No. 61/562,054 filed on Nov. 21, 2011, both of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention relates to golf balls. More specifically, the present invention relates to a golf ball cover layer composed of thermoplastic polyurethane.

Description of the Related Art

Traditional golf ball covers have been comprised of balata or blends of balata with elastomeric or plastic materials. The traditional balata covers are relatively soft and flexible. Upon impact, the soft balata covers compress against the surface of the club producing high spin. Consequently, the soft and flexible balata covers provide an experienced golfer with the ability to apply a spin to control the ball in flight in order to produce a draw or a fade, or a backspin which causes the ball to "bite" or stop abruptly on contact with the green. Moreover, the soft balata covers produce a soft "feel" to the low handicap player. Such playability properties (workability, feel, etc.) are particularly important in short iron play with low swing speeds and are exploited significantly by relatively skilled players.

Despite all the benefits of balata, balata covered golf balls are easily cut and/or damaged if mis-hit. Golf balls produced with balata or balata-containing cover compositions therefore have a relatively short life span.

As a result of this negative property, balata and its synthetic substitutes, trans-polybutadiene and transpolyisoprene, have been essentially replaced as the cover materials of choice by other cover materials such as ionomeric resins and polyurethanes.

Ionomeric resins are polymers containing interchain ionic bonding. As a result of their toughness, durability and flight characteristics, various ionomeric resins sold by E.I. DuPont de Nemours & Company under the trademark Surlyn® and by the Exxon Corporation (see U.S. Pat. No. 4,911,451) under the trademarks Escor® and Iotek®, have become widely utilized for the construction of golf ball covers over the traditional "balata" (transpolyisoprene, natural or synthetic) rubbers. As stated, the softer balata covers, although exhibiting enhanced playability properties, lack the durability (cut and abrasion resistance, fatigue endurance, etc.) properties required for repetitive play.

Ionomeric resins are generally ionic copolymers of an olefin, such as ethylene, and a metal salt of an unsaturated carboxylic acid, such as acrylic acid, methacrylic acid, or maleic acid. Metal ions, such as sodium or zinc, are used to neutralize some portion of the acidic groups in the copolymer resulting in a thermoplastic elastomer exhibiting enhanced properties, such as durability, for golf ball cover construction over balata. However, some of the advantages gained in increased durability have been offset to some degree by the decreases produced in playability. This is because although the ionomeric resins are very durable, they tend to be very hard when utilized for golf ball cover construction, and thus lack the degree of softness required to impart the spin necessary to control the ball in flight. Since the ionomeric resins are harder than balata, the ionomeric resin covers do not compress as much against the face of the club upon impact, thereby producing less spin. In addition, the harder and more durable ionomeric resins lack the "feel" characteristic associated with the softer balata related covers.

As a result, while there are many different commercial grades of ionomers available both from DuPont and Exxon, with a wide range of properties which vary according to the type and amount of metal cations, molecular weight, composition of the base resin (for example, relative content of ethylene and methacrylic and/or acrylic acid groups) and additive ingredients such as reinforcement agents, etc., a great deal of research continues in order to develop a golf ball cover composition exhibiting not only the improved impact resistance and carrying distance properties produced by the "hard" ionomeric resins, but also the playability (for example, "spin", "feel", etc.) characteristics previously associated with the "soft" balata covers, properties which are still desired by the more skilled golfer.

Furthermore, a number of different golf ball constructions, such as one-piece, two-piece (a solid resilient center or core with a molded cover), three-piece (a liquid or solid center, elastomeric winding about the center, and a molded cover), and multi-piece golf balls, have been developed to produce golf balls exhibiting enhanced playability and durability. The different types of materials utilized to formulate the cores, mantles, windings, covers, etc. of these balls dramatically alters the balls' overall characteristics. In addition, multi-layered covers containing one or more ionomer resins or other materials have also been formulated in an attempt to produce a golf ball having the overall distance, playability and durability characteristics desired.

For example, in various attempts to produce a durable, high spin golf ball, the golfing industry has blended the hard ionomer resins with a number of softer ionomeric resins and applied these blends to two-piece and three-piece golf balls. U.S. Pat. Nos. 4,884,814 and 5,120,791 are directed to cover compositions containing blends of hard and soft ionomeric resins. However, it has been found that golf ball covers formed from hard-soft ionomer blends tend to become scuffed more readily than covers made of hard ionomer alone. Consequently, it would be useful to develop a golf ball having a combination of softness and durability which is better than the softness-durability combination of a golf ball cover made from a hard-soft ionomer blend.

When used in golf ball cover stock, injection moldable TPUs offer significant economic advantages over thermoset polyurethanes and polyureas. In addition, they can be formulated to exhibit attractive properties with good "feel", controllability, and rebound resilience. Several methods have been used to improve the physical property profile and groove shear durability (i.e. resistance to scuffing, cutting, and tearing) of TPU golf ball covers. Most methodologies involve incorporating polyisocyanates into MDI based TPU cover layers in an effort to impart chemical cross-linking.

Regardless of these efforts, TPU cover compositions based on MDI will always exhibit limited resilience and durability because of the diisocyanate structure itself.

BRIEF SUMMARY OF THE INVENTION

When used as a diisocyanate in segmented block copolymers such as TPU, the symmetric structure of aromatic PPDI can result in a higher degree of phase separation and hard segment domain ordering relative to other aromatic diisocyanates such as MDI. This is especially true when chain extenders such as 1,4-butanediol are used along with PPDI in the hard segment. This kind of phase morphology coupled with high levels of hard segment domain cohesion imparts excellent low temperature flexibility, rubber like elasticity, and mechanical properties to the final elastomer.

The property attributes of PPDI based TPU make it ideal for use in injection moldable golf ball cover compositions. Balls with PPDI based TPU cover formulations exhibit improved resilience (C.O.R.) and groove cover shear durability relative to balls with MDI based TPU cover compositions at equivalent plaque hardness.

In this invention, TPU formulations based on PPDI as the diisocyanate are used to improve golf ball cover resilience and durability. These TPU cover compositions are injection molded using conventional polymer processing technologies and practices. As with MDI based TPU cover compositions, polyisocyanates can be incorporated into the TPU cover before, during, or after injection molding to improve groove shear durability even further. This includes polyisocyanate dipping techniques after forming.

One aspect of the present invention is a cover composed of a PPDI based thermoplastic polyurethane.

Another aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core (the combination of the inner core and the outer core) has a deflection ranging from 0.130 inch to 0.105 inch under a load of 100 kilograms. An inner mantle layer is disposed over the core, an outer mantle layer is disposed over the inner mantle layer, and a cover is disposed over the outer mantle. The golf ball has a diameter ranging form 1.65 inches to 1.685 inches. The cover is composed of a PPDI-based thermoplastic polyurethane.

Another aspect of the present invention is a golf ball comprising a core comprising an inner core center and an outer core layer disposed over the inner core center. The inner core center comprises a polybutadiene material and has a deflection of greater than 0.210 inch under a load of 100 kilograms, wherein the core has a deflection ranging from 0.120 inch to 0.090 inch under a load of approximately 200 pounds. The core has a diameter ranging from 1.40 inches to 1.64 inches. An inner mantle layer is disposed over the core, an outer mantle layer is disposed over the inner mantle layer, and a cover is disposed over the outer mantle.

Yet another aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core has a deflection ranging from 0.120 inch to 0.095 inch under a load of 100 kilograms. The core has a diameter ranging from 1.40 inches to 1.64 inches. An inner mantle layer is disposed over the core, an outer mantle layer is disposed over the inner mantle layer, and a PPDI-based thermoplastic polyurethane cover is disposed over the outer mantle.

Preferably, the golf ball cover is composed PPDI-based thermoplastic polyurethane. The golf ball cover preferably has a thickness ranging from 0.015 inch to 0.045 inch. Each mantle layer is preferably composed of an ionomer material. Alternatively, each mantle layer is composed of a blend of ionomer materials. Alternatively, at least one of the mantle layers is composed of a highly neutralized ionomer material. The combined mantle layers preferably have a thickness ranging from 0.030 inch to 0.075 inch, and most preferably less than 0.067 inch. The core preferably has a diameter ranging from 1.40 inches to 1.64 inches. Preferably, the golf ball has a coefficient of restitution greater than 0.79.

In another embodiment of the present invention the golf ball comprises a core comprising an inner core center and an outer core layer disposed over the inner core center. The inner core center comprises a polybutadiene material and has a deflection of greater than 0.210 inch under a load of 100 kilograms. The core (combination of the inner core and the outer core) has a deflection ranging from 0.120 inch to 0.095 inch under a load of 100 kilograms. The core has a deflection ranging from 0.120 inch to 0.090 inch under a load of 100 kilograms. An inner mantle layer is disposed over the core, an outer mantle is disposed over the inner mantle, and a cover is disposed over the outer mantle. The cover is composed of PPDI-based thermoplastic polyurethane and has a thickness ranging from 0.015 inch to 0.030 inch. The golf ball has a diameter ranging from 1.65 inches to 1.685 inches.

Preferably, each mantle layer is composed of an ionomer material. Alternatively, each mantle layer is composed of a blend of ionomer materials. Alternatively, at least one of the mantle layer is composed of a highly neutralized ionomer material. Preferably, each mantle layer has a thickness ranging from 0.030 inch to 0.090 inch.

In yet another embodiment, the golf ball of the present invention comprises a core comprising an inner core center and an outer core layer disposed over the inner core center. The inner core center comprises a polybutadiene material and has a deflection of greater than 0.220 inch under a load of 100 kilograms, wherein the core (combination of the inner core and the outer core) has a deflection ranging from 0.120 inch to 0.090 inch under a load of 200 pounds. The core has a diameter ranging from 1.40 inches to 1.64 inches. An inner mantle layer is disposed over the core, an outer mantle is disposed over the inner mantle, and a cover is disposed over the outer mantle.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
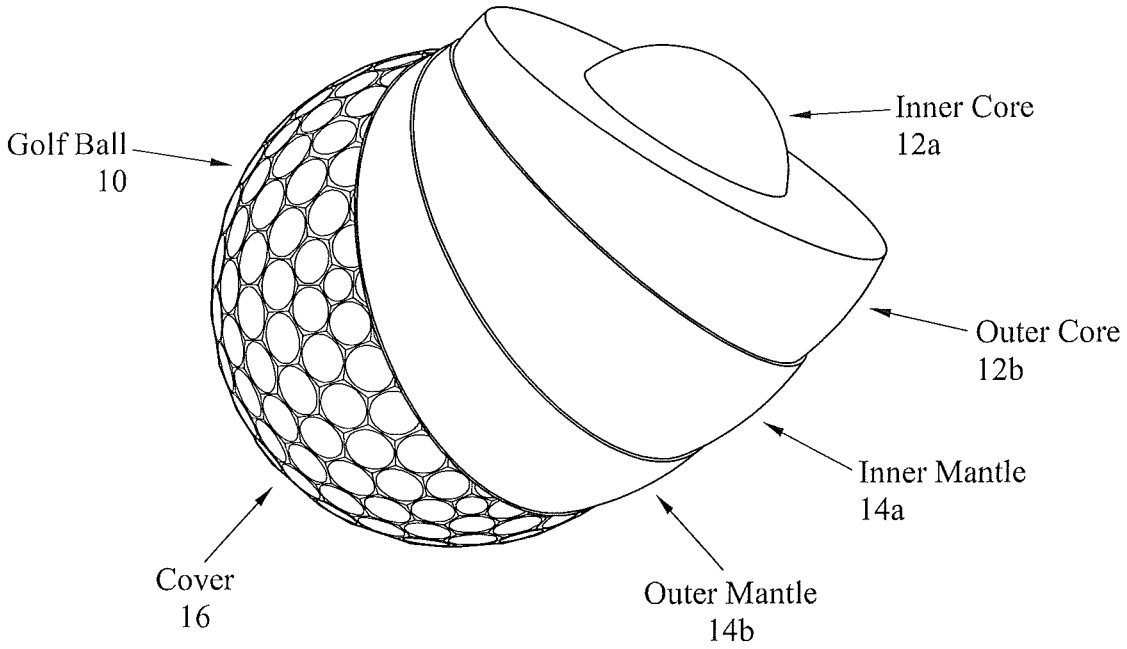
FIG. 1 is an exploded partial cut-away view of a golf ball.
Figure 2:
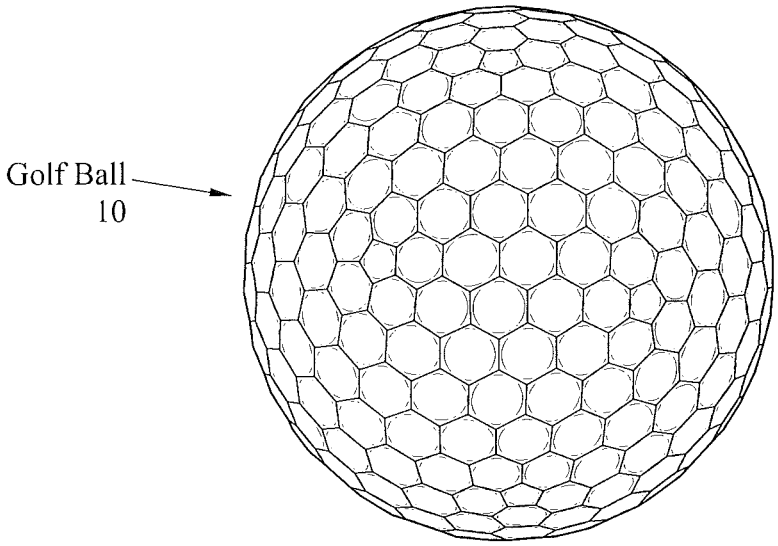
FIG. 2 is top perspective view of a golf ball.
Figure 3:
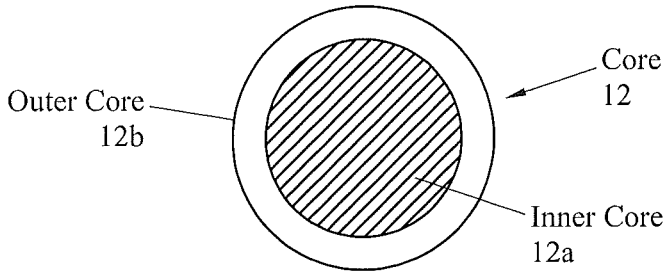
FIG. 3 is a cross-sectional view of a core component of a golf ball.
Figure 4:
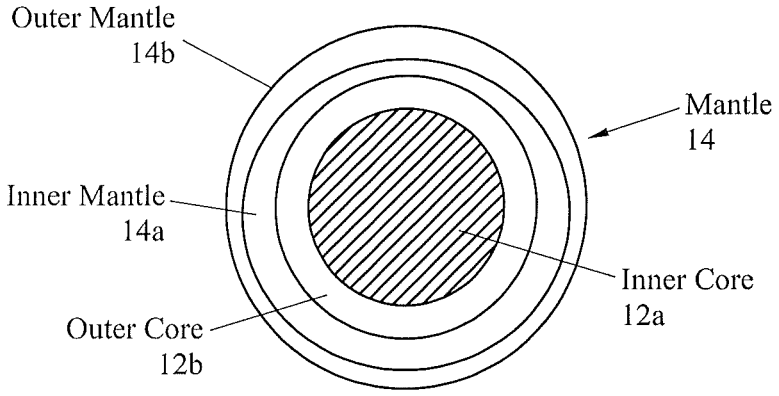
FIG. 4 is a cross-sectional view of a core component and a mantle component of a golf ball.
Figure 5:
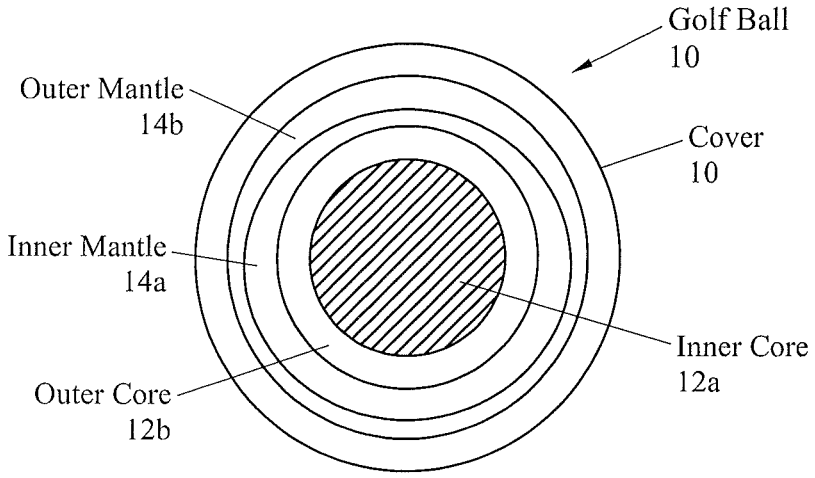
FIG. 5 is a cross-sectional view of an inner core layer, an outer core layer, an inner mantle layer, an outer mantle layer and a cover layer of a golf ball.

The present invention is directed to a molded golf ball component, such as a golf ball cover layer that is comprised of a soft, high melt index thermoplastic polyurethane, polyurea or polyurethane/polyurea material. Preferably, the golf ball component comprises a relatively thin (i.e., 0.075 inch or less, preferably 0.050 inch or less, more preferably 0.040 inch or less, even more preferably 0.030 inch, preferably 0.025 inch or less) outer cover layer.

In this screening study, golf balls with para-phenylene diisocyanate (PPDI) and 4,4'-diphenylmethane diisocyanate (MDI) based thermoplastic polyurethane (TPU) cover compositions were injection molded and characterized. Balls with PPDI based TPU cover formulations exhibited improved resilience (C.O.R.) and groove cover shear durability relative to balls with MDI based TPU cover compositions at equivalent plaque hardness.

A preferred embodiment of a golf ball 10 is shown in FIGS. 1-5. The golf ball 10 comprises an inner core 12*a*, an outer core 12*b*, an inner mantle 14*a*, an outer mantle 14*b* and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

The cover 16 is preferably composed of a PPDI-based thermoplastic polyurethane, and preferably has a thickness ranging from 0.025 inch to 0.04 inch, and more preferably ranging from 0.03 inch to 0.04 inch. The material of the cover 16 preferably has a Shore D plaque hardness ranging from 30 to 60, and more preferably from 40 to 50. The Shore D hardness measured on the cover 16 is preferably less than 56 Shore D. Preferably the cover 16 has a Shore A hardness of less than 96.

The mantle component 14 is composed of the inner mantle layer 14*a* and the outer mantle layer 14*b*. The mantle component 14 preferably has a thickness ranging from 0.05 inch to 0.15 inch, and more preferably from 0.06 inch to 0.08 inch. The outer mantle layer 14*b* is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer 14*a* is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer 14*b* is alternatively composed of a HPF material available from DuPont. Alternatively, the inner mantle layer 14*b* is composed of a material such as disclosed in Kennedy, III et al., U.S. Pat. No. 7,361,101 for a Golf Ball And Thermoplastic Material, which is hereby incorporated by reference in its entirety.

The outer mantle layer 14*b* is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer 14*b* preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core 12, the inner mantle layer 14*a* and the outer mantle layer 14*b* preferably ranges from 38 grams to 43 grams, more preferably from 39 to 41 grams, and is most preferably approximately 41 grams.

In an alternative embodiment, the inner mantle layer 14*a* is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer 14*a* has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer 14*b* is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b* preferably has a Shore D plaque hardness ranging preferably from 35 to 77, more preferably from 36 to 44, a most preferably approximately 40. The thickness of the outer mantle layer 14*b* preferably ranges from 0.025 inch to 0.100 inch, and more preferably ranges from 0.070 inch to 0.090 inch.

In yet another embodiment wherein the inner mantle layer 14*a* is thicker than the outer mantle layer 14*b* and the outer mantle layer 14*b* is harder than the inner mantle layer 14*a*, the inner mantle layer 14*a* is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer 14*a* has a Shore D plaque hardness ranging preferably from 30 to 77, more preferably from 30 to 50, and most preferably approximately 40. In this embodiment, the material for the outer mantle layer 14*b* has a Shore D plaque hardness ranging preferably from 40 to 77, more preferably from 50 to 71, and most preferably approximately 67. In this embodiment, the thickness of the inner mantle layer 14*a* preferably ranges from 0.030 inch to 0.090 inch, and the thickness of the outer mantle layer 14*b* ranges from 0.025 inch to 0.070 inch.

Preferably the inner core 12*a* has a diameter ranging from 0.75 inch to 1.20 inches, more preferably from 0.85 inch to 1.05 inch, and most preferably approximately 0.95 inch. Preferably the inner core 12*a* has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core 12*b* has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 6:
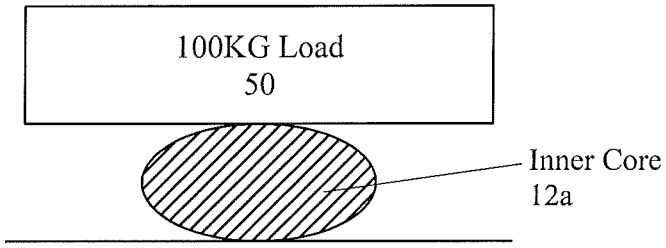
FIG. 6 is a cross-sectional view of an inner core layer under a 100 kilogram load.
Figure 7:
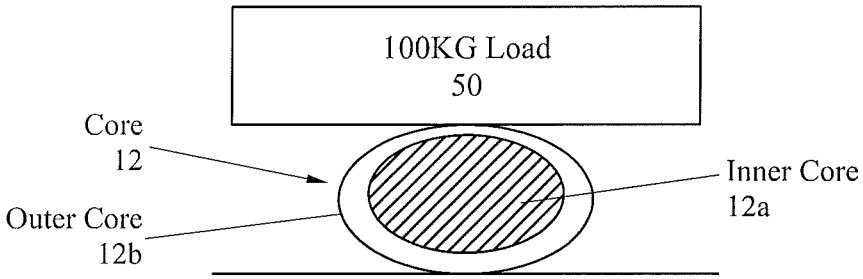
FIG. 7 is a cross-sectional view of a core under a 100 kilogram load.

Preferably the inner core 12*a* has a deflection of at least 0.230 inch under a load of 220 pounds, and the core 12 has a deflection of at least 0.080 inch under a load of 200 pounds. As shown in FIGS. 6 and 7, a mass 50 is loaded onto an inner core 12*a* and a core 12. As shown in FIGS. 6 and 7, the mass is 100 kilograms, approximately 220 pounds. Under a load of 100 kilograms, the inner core 12*a* preferably has a deflection from 0.230 inch to 0.300 inch. Under a load of 100 kilograms, preferably the core 12 has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core 12*a* ranges from 4 millimeters to 7 millimeters and more preferably from 5 millimeters to 6.5 millimeters. The dual core deflection differential allows for low spin off the tee to provide greater distance, and high spin on approach shots.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Simonds et al., U.S. Pat. No. 7,468,007 for a Dual Dimple Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers are measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the +5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A golf ball comprising:

a core comprising an inner core and an outer core disposed over the inner core, the inner core having a deflection of at least 0.230 inch under a load of 220 pounds, and the core having a deflection ranging from 0.08 inch to 0.150 inch under a load of 220 pounds;

an inner mantle layer disposed over the core, the inner mantle layer having a thickness ranging from 0.025 inch to 0.040 inch, the inner mantle layer composed of an ionomer material, the inner mantle layer material having a plaque Shore D hardness ranging from 65 to 71;

an outer mantle layer disposed over the inner mantle layer, the outer mantle layer material having a plaque Shore D hardness ranging from 36 to 44; and a cover layer disposed over the outer mantle layer, the cover having a thickness ranging from 0.025 inch to 0.040 inch, the cover composed of a PPDI-based thermoplastic polyurethane material, and the on cover Shore D hardness less than 56.

2. The golf ball according to claim 1 wherein the core is composed of a polybutadiene material, zinc penta chloride, organic peroxide, zinc stearate, zinc diacrylate and zinc oxide.

3. The golf ball according to claim 1 wherein the outer mantle layer is composed of a fully neutralized polymer material.

4. The golf ball according to claim 1 wherein the inner core has a diameter ranging from 0.75 inch to 1.20 inches, and the core has a diameter ranging from 1.25 inch to 1.55 inches.

5. A golf ball comprising:

a core comprising an inner core and an outer core disposed over the inner core, the inner core having a deflection of at least 0.230 inch under a load of 220 pounds, and the core having a deflection ranging from 0.08 inch to 0.150 inch under a load of 220 pounds;

an inner mantle layer disposed over the core, the inner mantle layer having a thickness ranging from 0.025 inch to 0.040 inch;

an outer mantle layer disposed over the inner mantle layer, the outer mantle layer material having a thickness ranging from 0.025 inch to 0.050 inch; and a cover layer disposed over the outer mantle layer, the cover having a thickness ranging from 0.025 inch to 0.040 inch, the cover composed of a PPDI-based thermoplastic polyurethane material, and the on cover Shore D hardness less than 56;

wherein the golf ball 10 preferably has a diameter of at least 1.68 inches, a mass ranging from 45 grams to 47 grams, a COR of at least 0.79, and a deformation under a 100 kilogram loading of at least 0.07 mm.

* * * * *